United States Patent [19]

Kugushin et al.

[11] 4,381,658

[45] May 3, 1983

[54] METHOD OF I-SECTION ROLLING IN CONTINUOUS MILL

[76] Inventors: Alexandr A. Kugushin, prospekt Metallurgov, 25, kv. 128; Vladimir N. Bespalov, ulitsa Kurako, 16, kv. 85; Jury O. Labetsky, ulitsa Kirova, 56, kv. 61; Vyacheslav I. Druzin, ulitsa Metallurgov, 37, kv. 47, all of Novokuznetsk Kemerovskoi oblasti; Vitaly K. Smirnov, ulitsa Malysheva, 130-b, kv. 31; Vladislav A. Shilov, ulitsa S, Kovalevskoi, 1, kv. 77, both of Sverdlovsk, all of U.S.S.R.

[21] Appl. No.: 228,610

[22] Filed: Jan. 26, 1981

[30] Foreign Application Priority Data

Dec. 28, 1979 [SU] U.S.S.R. ..... 2859614

[51] Int. Cl.[3] ..... B21B 1/12

[52] U.S. Cl. ..... 72/234; 72/366

[58] Field of Search ..... 72/221, 234, 235, 365, 72/366, 240, 177

[56] References Cited

U.S. PATENT DOCUMENTS

| | | | |
|---|---|---|---|
| 271,225 | 1/1883 | Daniels | 72/235 |
| 1,013,567 | 1/1912 | Sack | 72/177 |
| 1,302,497 | 5/1919 | Barbour | 72/234 |

FOREIGN PATENT DOCUMENTS 966976 6/1982 U.S.S.R. .

OTHER PUBLICATIONS

Beinon, "Roll Pass Design and Rolling Mill Arrangement", Metallurgizdat, 1960, pp. 23–24.

Zhaden, et al., "Rolling in Beam Pass System without Alternation of Flange Working", Steel, No. 9, 1976, pp. 825–828.

Ammerling, et al., "Continuous Medium Section Beam and Shape Mill", Iron and Steel Engineer, vol. 51, No. 1, 1974, pp. 65–71.

Takaaki, "Development of Production of Compound Steel Sections and Round Bars", Kinzoku, vol. 45, No. 1, 1975, pp. 72–78.

Krocek, et al., "Possibilities of Beam Rolling in Continuous Mills", Hutnik, vol. 23, No. 1, 1973, pp. 24–25.

Gritsuk, et al., "Production of Wide-Flange I-Beams", Metallurgia Publishing House, 1973, p. 165.

Bakhtinov, et al., "Roll Pass Design", Metallurgizdat, 1953, pp. 586–592.

Polanski, "Pass Relations in the Rolling of Structural Shapes in High Output Mills", Hutnik, vol. 26, No. 5, 1976, pp. 174–181.

*Primary Examiner*—Francis S. Husar
*Assistant Examiner*—Jonathan L. Scherer
*Attorney, Agent, or Firm*—Lilling & Greenspan

[57] ABSTRACT

The method of I-section rolling in a continuous mill includes successive rolling of a bar in horizontal slitting passes, horizontal closed roughing beam passes with alternate directions of the slope of the flange outer sides, vertical reduction passes and finishing universal beam passes; and it also includes working of bent-out live flanges of the bar prior to reversal of the direction of the slope of the flange outer sides in the closed beam passes. All the passes are arranged one after another according to the production process in a combination which provides for producing an I-section. In all the horizontal closed roughing beam passes, the rolling of the bar is effected with the flange outer sides having a slope of 15–100 percent on the live flanges and a slope of 8–12 percent on the dead flanges. In the vertical reduction passes the outer sides of the bar are worked to slopes corresponding to the slopes of the outer sides of the dead flanges of the succeeding horizontal closed roughing beam pass. The bent-out flanges of the bar are worked to slopes corresponding to the slopes of the outer sides of the dead flanges of the succeeding horizontal closed roughing beam pass.

3 Claims, 21 Drawing Figures

19

$\varphi_5$
20

$\varphi_6'$
$\varphi_6$
21

$\varphi_7'$
$\varphi_7$
$B_5$
22

$B_5$
$\varphi_8$
23

$\varphi_9$
$\varphi_9'$
24

$\varphi_{10}$
$\varphi_{10}'$
$B_6$
25

$B_6$
26

27

28

29

30

31

32

33

METHOD OF I-SECTION ROLLING IN CONTINUOUS MILL

FIELD OF THE INVENTION

The present invention relates to structural shape rolling means and has particular reference to a method of I-section rolling in a continuous mill.

The invention may be used with particular advantage in a completely continuous rolling mill with horizontal-roll, vertical-roll and universal stands.

It is expedient to employ continuous rolling mills in order to obtain a maximum output and to enhance dimensional stability and quality of I-sections, especially when rolling thin shapes.

Rolling in continuous mills provides a maximum productive capacity, a minimum bar temperature drop, and high accuracy and stability of dimensions of I-sections, particularly of thin and light-weight ones. Furthermore, continuous rolling improves mechanical properties of I-bars.

DESCRIPTION OF THE PRIOR ART

I-section bars are produced by various methods.

Known in the art is a method of I-section rolling in mills with side-by-side stand arrangement (Ross E. Beinon "Roll Pass Design and Rolling Mill Arrangement", published in 1960 by Metallurgizdat, pages 23–24).

By this method, rolling is done in horizontal closed beam passes having a web portion, dead flanges with an outer side slope of 2–4 percent and live flanges with an outer side slope of 5–12 percent. The position of the live and dead flanges with respect to the horizontal axis is alternately reversed in two adjacent passes. Accordingly, the direction of slope of the flange outer sides is reversed after each pass.

A rectangular blank is rolled successively first in a horizontal slitting pass and then in horizontal closed beam passes, the blank being passed once through each pass. This produces an I-section bar with a web and live and dead flanges whose configuration corresponds to that of the horizontal closed beam pass.

Owing to alternation of the live and dead flanges in the adjacent beam passes, the live flanges of the blank enter the dead flanges of the next closed beam pass and, conversely, the dead flanges of the blank enter the live flanges of the beam pass, the width of the blank across the bent-out flanges being likely to exceed the width of the next horizontal closed beam pass across the dead flanges.

To facilitate entry and exit of the bar, inlet and outlet guides are provided at the corresponding sides of the rolls.

After each pass the opposite end of the bar is alternately fed into the rolls. Inasmuch as local creep of the web metal occurs relative to the rolls in the reduction zone, the alternation of the bar ends results in local elongations of the bar web at both ends of the bar. These elongations facilitate bar entry into the passes, as the pass web portion bites them ahead of the flanges and pulls the bar into the rolls although the bar width across the live flanges exceeds the pass width across the dead flanges. The local elongations of the web at the bar ends also enable the outlet guides to surely withdraw the bar from the rolls, as those elongations leave the pass ahead of the bar flanges and, coming onto the outlet guides, help pull out the bar gripped in the deep dead flanges of the horizontal closed beam pass.

However, the method of I-section rolling in mills of side-by-side stand arrangement has a low output and causes a large drop of bar temperature in the rolling process, which adversely affects the accuracy and stability of I-bar dimensions.

Another disadvantage of this method is that the alternation of the positions of the live and dead flanges of the adjacent passes and the reversal of the direction of the flange outer side slope limit the degree of the slope and, consequently, the reduction of the bar in the thickness of the live flanges, inasmuch as the amount of this reduction is directly proportional to the slope of the outer sides of the live flanges of the horizontal closed beam passes. Increasing the slope of the outer sides of the live flanges of said passes to more than 10–12 percent substantially impairs the conditions of bar entry into the horizontal closed beam passes, as the bar width across the bent-out live flanges becomes considerably more than the pass width across the dead flanges. In these circumstances the outer sides of the bar live flanges foul the sides of the pass dead flanges, thereby interfering with pulling the bar into the rolls, which results in instability of I-bar dimensions and in defects on the bar flanges. Therefore, it is inadvisable for the slope of the live flange outer sides in closed beam passes to exceed 12 percent.

Also known in the art is a method of I-section rolling in horizontal closed beam passes (Magazine "Steel" published in 1976, No. 9. Zhadan V. T. et al., "Rolling in Beam Pass System without Alternation of Flange Working", pages 825–828).

By this method, I-section rolling in mills of side-by-side stand arrangement is carried out in a horizontal slitting pass and horizontal closed beam passes, the position of the live and dead flanges with respect to the horizontal axis in adjacent passes being alternated every two passes. In this case there are pairs of adjacent passes wherein live and dead flanges are in the same position with respect to the horizontal axis and, consequently, the outer sides of the flanges in both passes of the pair slope in the same direction. Since the positions of the flanges with respect to the horizontal axis are not alternated in each of the aforesaid pairs of adjacent passes, the conditions of bar entry into the second pass of each pair are improved, inasmuch as in this case the slope of the outer sides of the bar flanges has the same direction as the slope of the sides of the pass flanges and the bar width is less than the corresponding width of the pass.

However, in each of said pairs of passes the first horizontal closed beam pass has unfavorable bar entry conditions because of reversal of the direction of the slope of the flange outer sides after the preceding pass. Therefore, the slope of the outer sides of the pass live flanges is limited to 10–12 percent, which restricts bar reduction in the live flanges of the horizontal closed beam passes. Furthermore, this method suffers from a low output and a large drop of bar temperature in rolling.

Well known in the art is a method of I-section rolling in semicontinuous mills consisting of a reversing stand and continuous trains of horizontal-roll universal stands (Magazine "Iron and Steel Engineer", published in 1974, volume 51, No. 1, W. Y. Ammerling et al., "Continuous Medium Section Beam and Shape Mill", pages 65–71, N.B. page 70, Magazine "Kinzoku", published in 1975, volume 45, No. 1, N. Takaaki "Development of Production of Compound Steel Sections and Round Bars", pages 72–78, N.B. page 75).

By this method, in the reversing stand rolling is done by the use of horizontal slitting and beam passes, whereas in the continuous stand trains use is made of horizontal closed beam passes and universal beam passes, the slope of the flange outer sides in the former being as stated above.

A rectangular blank is given three to five passes in the reversing stand, the front and rear ends of the bar being alternated at the roll entry. With this mode of operation, local web elongations, as described previously, are produced on both ends of the bar. Then the bar is rolled in the continuous stand train, being fed into each stand with the same end first. Said local web elongations provide for smooth entry of the bar into the horizontal closed beam passes and sure exit of the bar from the dead flanges of those passes as described above for the rolling in mills of side-by-side stand arrangement.

The employment of the continuous train of stands increases production efficiency of the mill and provides for enhanced accuracy and stability of the rolled shapes.

However, the employment of the reversing stand puts a limitation on the increase of the mill production efficiency, adds to the drop of rolling temperature and adversely affects the working capability of the continuous train.

Also known in the art is a method of I-section rolling in staggered train mills with unidirectional horizontal-roll stands (for example, the magazine "Hutnik", of CSSR, 1973, volume 23, No. 1, Krocek F., Adamus I. "Possibilities of Beam Rolling in Continuous Mills", pages 24–25) or unidirectional horizontal-roll and vertical-roll stands, and one or several universal stands (for example, Gritsuk N. F., Antonov S. P. "Production of Wide-Flange I-Beams, published in 1973 by Metallurgia Publishing House," page 165). Usually the stands are arranged in three parallel trains so that the direction of rolling is reversed in transfer from one train to the other.

By this method, in mills with horizontal-roll stands rolling is done by the use of horizontal slitting passes and horizontal closed beam passes, whereas in mills with horizontal-roll, vertical-roll and universal stands rolling is done by the use of horizontal slitting passes, horizontal closed beam passes, vertical reduction passes, and universal beam passes.

A rectangular blank is rolled in one pass in each of the stands in succession. Inasmuch as the direction of rolling is reversed in transfer from train to train, the entering ends of the bar are alternated due to which local web elongations are produced on both ends of the bar, which elongations facilitate bar entry and exit as noted above.

I-section rolling by this method increases mill production efficiency due to dispensing with reversing stands and obviating loss of time involved in reversing rolling.

However, during transfer of the bar from stand to stand and especially from train to train the bar temperature drops considerably, which adversely affects accuracy and stability of I-bar dimensions.

Also known in the art is a method of I-section rolling in a completely continuous mill consisting only of horizontal-roll stands (refer to Bakhtinov B. P., Shternov M. M. "Roll Pass Design" published in 1953 by Metallurgizdat, pages 586–592) or of horizontal-roll and combination (horizontal- and vertical-roll) stands in a roughing train and universal and combination stands in a finishing train (Magazine "Hutnik", of CSSR, 1976, volume 26, No. 5, Polanski P., "Pass Relations in the Rolling of Structural Shapes in High-Output Mills", pages 174–181, N.B. page 176). The aforementioned combination stands can operate as either horizontal-roll or vertical-roll stands.

By this method, rolling is performed in a horizontal slitting pass, in horizontal closed roughing beam passes with alternately reversed positions of live and dead flanges in adjacent passes and accordingly reversed directions of the slope of the flange outer sides, and in universal finishing beam passes. Owing to provision of combination stands, rolling in vertical reducing passes can be effected.

The outer slope of the horizontal closed roughing beam passes does not exceed a customary value of 2–4 percent for the dead flanges and 6–12 percent for the live flanges.

A rectangular blank is rolled successively in a horizontal slitting pass, horizontal closed roughing beam passes and universal finishing beam passes. The bar is given one pass in each stand, the same bar end always entering the rolls. In order to facilitate entry of the bent-out live flanges of the bar into the dead flanges of the succeeding horizontal closed beam pass, the bent-out live flanges of the bar are straightened by inlet guides by virtue of the bar being pushed therethrough by the rolls of the preceding stand.

Rolling is performed simultaneously in several mill stands or in all of them, which gives a maximum output and provides for a minimum bar temperature drop during the rolling process as well as for accuracy and stability of the dimensions of the rolled shapes.

However, I-section rolling by this method presents considerable difficulties arising from the fact that the same end of the bar always enters the passes. This condition, as shown by operating experience with continuous mills and by special research, does not produce a local elongation of the bar web at the entering end thereof although it is subjected to the greatest reduction. Conversely, the web at the entering end of the bar is shortened with respect to the flanges and becomes laminated. This phenomenon is attributed to the velocity characteristics of metal flow through the deformation zone of a horizontal closed beam pass. As is known, the peripheral velocity of rolls is considerably lower at the flange top than at the web since the roll diameter at the flange top is always smaller than at the web. Inasmuch as the bar exit velocity is determined by the mean contact diameter of the roll, the velocity of the bar flanges exceeds the roll velocity, whereas the web velocity is below that. Therefore, the metal in the bar web throughout the length of the deformation zone creeps backward with respect to the rolls, due to which the web at the bar entering end shortens relative to the flanges and the web metal becomes laminated, whereas the web at the bar leaving end acquires a local elongation.

The lack of a local elongation of the bar entering end substantially hampers bar entry into horizontal closed beam passes and the withdrawal of the bar from the rolls by the outlet guides, inasmuch as the entry of the bar into the pass and its exit therefrom commence at the flanges, not at the web (as the case is when the web at the bar entering end has a local elongation). It will be noted that the aforementioned straightening of the bent-out live flanges of the bar by the inlet guides has not been carried into effect hitherto because of a number of difficulties such as the need for providing special heavily built inlet guides capable of withstanding large forces, heavy wear on those guides, etc.

Since the bar width across the bent-out live flanges exceeds the width of the succeeding horizontal roughing beam pass across the dead flanges thereof, the outer sides of the bar live flanges strike the outer sides of the pass dead flanges when the bar enters the pass. Owing to seizure of the bar metal in the dead flanges of the pass, the bar strikes the outlet guides when leaving the pass, which causes wear and damage to the outlet guides and results in winding of the bar around the rolls. The difficulties described above have prevented heretofore the accomplishment of I-section rolling in continuous mills with horizontal-roll and combination stands in roughing trains.

SUMMARY OF THE INVENTION

It is the principal object of the present invention to provide a method of I-section rolling in a continuous mill whereby facilitation may be effected of bar entry into horizontal closed roughing beam passes and of bar exit therefrom, there being no local elongation of the bar web at the bar entering end.

It is another object of the present invention to provide a method of I-section rolling in a continuous mill whereby durability of outlet guides may be increased and damage to same may be obviated, there being no local elongation of the bar web at the bar entering end.

It is still another object of the present invention to provide a method of I-section rolling in a continuous mill whereby winding of the bar around the rolls may be prevented, there being no local elongation of the bar web at the bar entering end.

These and other objects are achieved by a method of continuous I-section rolling including successive rolling of a bar in horizontal slitting passes, horizontal closed roughing beam passes with alternate directions of the slope of flange outer sides, vertical reduction passes and finishing universal beam passes arranged one after another according to the production process in a combination which provides for producing an I-section and, further including working of bent-out live flanges of the bar prior to reversal of the direction of the slope of the flange outer sides in the closed beam passes. According to the invention, in all the horizontal closed roughing beam passes the rolling of the bar is effected with the flange outer sides having a slope of 15–100 percent on the live flanges and a slope of 8–12 percent on the dead flanges; and in the vertical reduction passes the outer sides of the bar are worked to slopes corresponding to the slopes of the outer sides of the dead flanges of the succeeding horizontal closed roughing beam pass, and the bent-out flanges of the bar being worked to slopes corresponding to the slopes of the outer sides of the dead flanges of the succeeding horizontal closed roughing beam pass.

Since, after the bar has been rolled in a vertical reduction pass or the live flanges of the bar have been worked, the slope of the bar outer sides corresponds to that of the outer sides of the dead flanges of the succeeding horizontal closed roughing beam pass, the entry of the bar into said pass is facilitated inasmuch as the contour of the bar side surface is parallel to the contour of the outer side of the dead flange of said pass, whereas the width of the bar is always less than the corresponding width of the pass by the amount of spread.

The use of a greater flange outer side slope than in the prior art, i.e., 15–100 percent on the live flanges and 8–12 percent on the dead flanges, facilitates the exit of the bar from the horizontal closed roughing beam passes. It is particularly important to increase the slope of the outer sides of the live flanges, since it should always be greater than the slope of the outer sides of the dead flanges. Such increase in the slope of the outer sides of the live flanges provides an increase in the bending moment acting on the bar from the live flanges of the horizontal closed roughing beam pass, which facilitates withdrawal of the bar from the dead flanges of the pass and improves the conditions of bar exit from the rolls.

The greater the slope of the outer sides of the live flanges (i.e. the nearer the contour of said sides is to the horizontal), the greater will be said bending moment and the easier will be the exit of the bar from the horizontal closed roughing beam passes. However, it is impracticable to increase said slope in excess of 100 percent (an angle of 45°) as such an increase will adversely affect the stability of the bar live flanges in the working thereof prior to entry into the succeeding horizontal closed roughing beam pass. In such a case the bar live flanges are likely to be overbent toward the dead flanges, and the job will be spoiled.

When the slope of the outer sides of the live flanges of the horizontal closed roughing beam passes is less than 15 percent, the bending moment acting on the bar from the live flange of the pass is insufficient for the bar to surely go out of the dead flanges of the pass, the bar being liable to jam in the dead flanges of the horizontal closed roughing beam pass and to winding around the roll.

The use of increased slopes of the live flanges of the horizontal closed roughing beam passes not only facilitates bar exit from said passes, but also provides for increasing the reduction of the bar in the live flanges of said passes. This makes it possible to decrease the number of rolling passes performed or to increase the dimension of the initial blank, thereby enhancing the production efficiency of the mill.

Increasing the slope of the outer sides of the dead flanges of the horizontal closed roughing beam passes to 8–12 percent helps decrease side jamming of the bar and, consequently, facilitates bar exit from the pass.

As shown by the experience in operating a continuous medium section mill in the U.S.S.R., when the slope of the outer sides of the dead flanges is less than 8 percent, the bar strikes the outlet guides heavily enough to damage them and is liable to winding around the rolls. Increasing said slope to more than 12 percent along with increasing the slope of the live flanges to 100 percent leads to overbending the bar flanges in the rolling process, due to which defects may develop in the junctions of the I-bar web and flanges.

According to the invention, it is desirable that the working of the bent-out flanges of the bar should be effected in vertical bending passes.

The employment of vertical bending passes for working the bent-out flanges of the bar is dictated by increasing the slope of the outer sides of said flanges to 15–100 percent according to the invention. With such a slope, the method of the prior art whereby the bent-out flanges of the bar are worked (straightened) by means of the inlet guides of the succeeding stand in a continuous mill is not applicable inasmuch as too much force has to be exerted by the inlet guides and by the preceding stand which pushes the bar through the inlet guides. In these circumstances the bar may loose longitudinal stability and bend between the stands, which will interfere with the entry of the bar into the pass of the succeeding stand. Furthermore, the method of the prior art cannot be used for working the bent-out flanges of the bar before the first horizontal-roll stand of the train.

In the working of the bent-out live flanges in vertical bending passes formed by grooves in vertical rolls, the rolls pull in the bar by virtue of contact friction and bend the live flanges to the required angle. For this operation no assistance is needed from the preceding stand of the mill. The vertical-roll stand provides the required bending force since it is designed to exert heavy forces in bar rolling.

When working the bar in a vertical bending pass, the bar width is not reduced on the horizontal axis in order to obviate instability of the I-bar web.

It is further desirable that the last roughing step should be performed in a horizontal open beam pass, the web thickness reduction ratio and the flange height reduction ratio being 1.1–1.3.

Performing the last roughing step in a horizontal open beam pass is desirable because of the necessity of producing a horizontally symmetric rough I-bar preparatory to transferring same to finishing universal stands. The I-bar in question should have flanges of equal height and an even straight web.

As is known, bar rolling in horizontal closed roughing beam passes produces an increase in the height of the bar live flanges and a in the height of the bar dead flanges, said increase and decrease being different. Therefore, after the bar is rolled in horizontal closed roughing beam passes, the height of the bar live and dead flanges may be inequal, which condition is impermissible for rolling in finishing universal stands.

Furthermore, as a result of working the flanges in the preceding vertical bending pass, the bar web may be bent and need straightening.

In order to produce a rough I-bar with flanges of equal height and an even web, the web thickness reduction ratio and the flange height reduction ratio should be 1.1–1.3. With a smaller ratio, equalization of the flange height and web thickness may fail to be obtained. With a larger ratio, the stability of flange height may be affected and the pass overfilled, a fin being produced on the bar side.

By carrying into effect the proposed method of I-section rolling in a continuous mill, it is possible to facilitate bar entry into and exit from horizontal closing roughing beam passes, thereby providing for increasing durability of outlet guides, obviating damage to same and, consequently, preventing winding of the bar around the rolls, there being no local elongation of the bar web at the bar entering end.

Moreover, the method of the present invention provides for increasing bar reduction in live flanges of horizontal closed roughing beam passes and thereby enhances the production efficiency of a continuous rolling mill.

BRIEF DESCRIPTION OF THE DRAWINGS

For a better understanding of the invention, various embodiments thereof will now be described by way of example with reference to the accompanying drawings, wherein.

DETAILED DESCRIPTION OF THE INVENTION

Figures 1, 2, 3, 4, 5, 6:
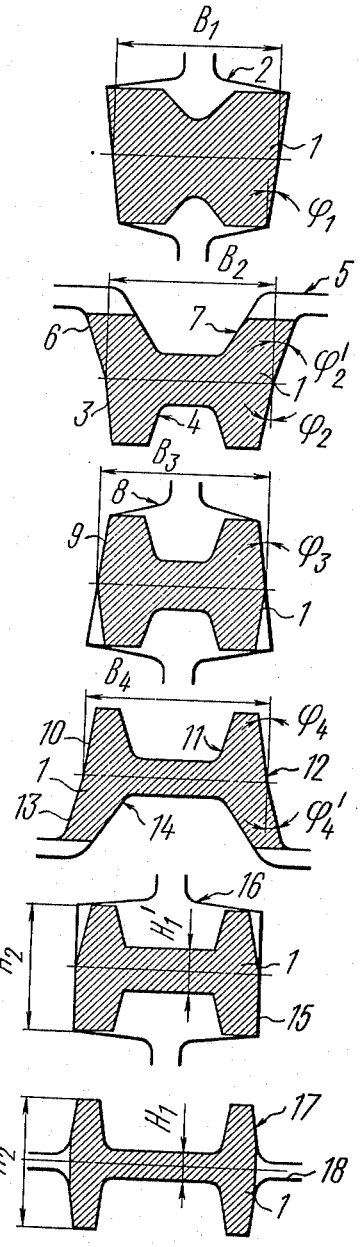
FIG. 1 diagrammatically shows a vertical reduction pass and the section of the bar being rolled therein according to the invention.
FIG. 2 diagrammatically shows a horizontal closed roughing beam pass succeeding the vertical reduction pass and the section of the bar being rolled in the former according to the invention.
FIG. 3 diagrammatically shows a vertical bending pass and the section of the bar being rolled therein according to the invention.
FIG. 4 diagrammatically shows a horizontal closed roughing beam pass succeeding the vertical bending pass and the section of the bar being rolled in the former according to the invention.
FIG. 5 diagrammatically shows a vertical bending pass preceding the last roughing step performed in an open beam pass and the section of the bar being rolled in the former according to the invention.
FIG. 6 diagrammatically shows a horizontal open beam pass and the section of the bar being rolled therein according to the invention.

The method of I-section rolling in a continuous mill is carried into effect as follows:

A blank of rectangular or square section is first rolled in a conventional open or closed horizontal slitting pass to a roughly I-shaped bar. Then the bar 1 (FIG. 1) is rolled in a vertical reduction pass 2, wherein the outer sides of the bar 1 are worked to the slopes tg $\rho_1$ equal to the slopes tg $\rho_2$ (FIG. 2) of the outer sides 3 of the dead flanges 4 of the succeeding horizontal closed roughing beam pass 5. Thereafter the bar 1 is rolled in the horizontal closed roughing beam pass 5. Since the slope tg $\rho_1$ (FIG. 1) is equal to the slope tg $\rho_2$ (FIG. 2), the bar 1 readily and smoothly enters the horizontal closed roughing beam pass 5, inasmuch as the contour of the outer side of the bar 1 is parallel to the contour of the outer side 3 (FIG. 2) of the dead flange 4 of the horizontal closed roughing beam pass 5. The width $B_1$ (FIG. 1) of the bar 1 is less than the width $B_2$ (FIG. 2) of the horizontal closed roughing beam pass 5 due to inevitable spreading of the bar 1.

The outer sides 6 of the live flanges 7 of the horizontal closed roughing beam pass 5 have a slope tg $\rho'_2$ of 15–100 percent and the outer sides 3 of the dead flange 4 of said pass have a slope tg $\rho_2$ of 8–12 percent. These slopes ensure faultless and smooth exit of the bar 1 from the pass 5 since the moment acting on the bar 1 from the live flange 7 is greater than the moment acting on the bar 1 from the dead flange 4, this condition facilitating withdrawal of the bar 1 from the dead flanges 4 of the closed beam pass 5. Furthermore, the slopes tg $\rho_2$ of the outer sides of the dead flanges 4 are greater than such slopes in the prior art, which condition decreases jamming of the bar 1 in the dead flanges 4 of the horizontal closed roughing beam pass 5, also facilitating exit of the bar 1 from the pass 5.

After the bar 1 leaves the pass 5, the live flanges of this bar are rolled in a vertical bending pass 8 (FIG. 3). Here the outer sides 9 of the live flanges of the bar 1 are worked to the slopes tg $\rho_2$ corresponding in magnitude and direction to the slopes tg $\rho_4$ (FIG. 4) of the outer sides 10 of the dead flanges 11 of the succeeding horizontal closed roughing beam pass 12. In this pass the width $B_2$ (FIG. 2) of the bar 1 is not reduced, i.e. $B_2=B_3$.

Thereafter the bar 1 is rolled in a horizontal closed roughing beam pass 12. Since the slope tg $\rho_3$ (FIG. 3) of the already rolled live flange of the bar 1 is equal to the slope tg $\rho_4$ (FIG. 4) of the outer side 10 of the dead flange 11 of the horizontal closed roughing beam pass 12 and the width $B_4$ of the pass is greater than the width $B_3$ (FIG. 3) of the bar, provision is made for free entry of the bar 1 into the pass 12 (FIG. 4). Since the slopes tg $\rho_4$ and tg $\rho'_4$ are equal to 8–12 percent and 15–100 percent respectively, provision is made for facilitating the exit of the bar 1 from the pass 12. In this case, the outer face 13 of the live flange 14 is subjected to a bending moment which helps extract the bar 1 from the deep dead flanges 11 of the pass 12.

After the bar 1 is rolled in the horizontal closed roughing beam pass 12, the bent-out live flanges of the bar 1 are again worked in a vertical bending pass. If this working is done before rolling the bar 1 in a horizontal closed roughing beam pass, it is to be carried out in the same manner as shown in FIG. 3 and described above. If this working is done before making the last roughing step in a horizontal open beam pass, the bent-out live flanges of the bar 1 are to be merely set upright as shown in FIG. 5. To this end vertical sides 15 (FIG. 5) are provided in a vertical bending pass 16.

The last roughing step is performed in a horizontal open beam pass 17 (FIG. 6), the web thickness reduction ratio $H_1'/H_1$ and the flange height reduction ratio $H_2'/H_2$ being 1.1–1.3. Referring to FIGS. 5 and 6:

$H'_1$ and $H_1$ represent the thickness of the web of the bar 1 in the earlier pass and in the later pass respectively; and $H'_2$ and $H_2$ represent the height of the flanges of the bar 1 in the earlier pass and in the later pass respectively.

With the web thickness reduction ratio $H'_1/H_1<1.1$, the web of the bar 1 may be uneven. With the flange height reduction ratio $H'_2/H_2<1.1$, the flanges of the rough I-bar 1 may differ in height.

Exceeding the reduction ratios ($H'_1/H_1>1.3$ and $H'_2/H_2>>1.3$) results in instability of the height of the bar flanges and in overfilling of the open pass 17, the metal being forced out into the roll space 18.

One to three horizontal closed roughing beam passes with the same direction of slope of the outer sides of the live and dead flanges may be installed between two vertical bending passes in a roughing train of a continuous mill. The use of a larger number of such passes between two vertical bending passes is not recommended, otherwise the live and dead flanges of the bar will substantially differ in height, the bar being asymmetric with respect to the horizontal axis.

By rolling the bar 1 successively in the passes 2, 5, 8, 12, 16 and 17 (FIGS. 1 through 6 respectively) of the roughing train, a rough I-beam is produced which is thereafter rolled in universal beam passes of a finishing train.

Various arrangements and sequence of passes for continuous I-section rolling may be used as described below.

Figures 7, 8, 9, 10, 11, 12, 13, 14, 15, 16, 17, 18, 19, 20, 21:
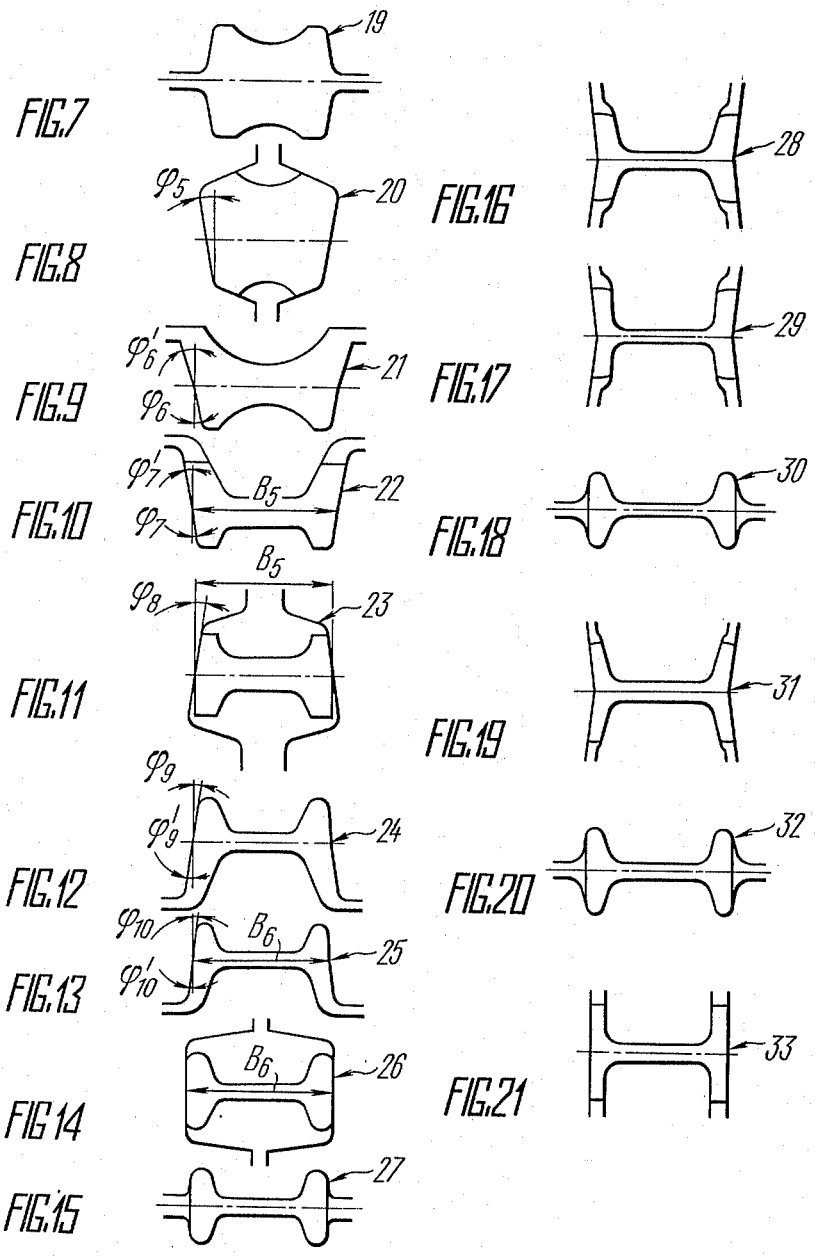
FIGS. 7–15 diagrammatically show the arrangement and sequence of passes for continuous I-section rolling in a train of roughing stands according to the invention.
FIGS. 16–21 diagrammatically show the arrangement and sequence of passes for I-section rolling in a train of finishing stands according to the invention.

For example, the following passes may be installed in the roughing train of a medium section continuous mill:

1st stand—a horizontal open slitting pass 19 (FIG. 7);

2nd stand—a vertical reducing pass 20 (FIG. 8);

3rd and 4th stands—horizontal closed roughing beam passes 21 (FIG. 9) and 22 (FIG. 10);

5th stand—a vertical bending pass 23 (FIG. 11);

6th and 7th stands—horizontal closed roughing beam passes 24 (FIG. 12) and 25 (FIG. 13);

8th stand—a vertical bending pass 26 (FIG. 14);

9th stand—a horizontal open beam pass 27 (FIG. 15).

In the finishing train use is made of universal beam passes 28 (FIG. 16) and 29 (FIG. 17), a horizontal open beam checking pass 30 (FIG. 18), a universal beam pass 31 (FIG. 19), a horizontal open beam checking pass 32 (FIG. 20) and a universal beam pass 33 (FIG. 21).

In the vertical reduction pass 20 (FIG. 8) of the 2nd stand the slope tg $\rho_5$ of the bar outer sides is 12 percent and corresponds to the slope of the dead flanges of the succeeding horizontal beam pass 21 (FIG. 9), which is tg $\rho_6=12$ percent.

For rolling the bar in the horizontal closed roughing beam passes, the following outer side slopes should be used:

Live flanges

3rd stand (FIG. 9) tg $\rho_6'=15$ percent
4th stand (FIG. 10) tg $\rho_7'=15$ percent
6th stand (FIG. 12) tg $\rho_9'=20$ percent
7th stand (FIG. 13) tg $\rho_{10}'=25$ percent Dead flanges 3rd stand (FIG. 9) tg $\rho_6=12$ percent
4th stand (FIG. 10) tg $\rho_7=12$ percent
6th stand (FIG. 12) tg $\rho_9=10$ percent
7th stand (FIG. 13) tg $\rho_{10}=8$ percent In the vertical bending pass 23 (FIG. 11) of the 5th stand the bent-out flanges of the bar are worked to an outer side slope of tg $\rho_8=10$ percent which corresponds to the slope of the outer sides of the dead flanges of the succeeding horizontal closed roughing beam pass 24 (FIG. 12) of the 6th stand. The bar width $B_5$ (FIG. 10) in the 4th stand and in the 5th stand (FIG. 11) remains unchanged.

In the vertical bending pass 26 (FIG. 14) the live flanges of the bar are straightened without changing the bar width $B_6$ (FIGS. 13 and 14).

In the horizontal open beam pass 27 (FIG. 15) the rolling of the bar is carried out according to a web thickness reduction ratio $H'_1/H_1$ of 1.1 and a flange height reduction ratio $H'_2/H_2$ of 1.2.

In all the stands of the roughing train the rolling of the bar proceeds steadily, there being no interference and impacts at the entry and exit of the bar into and from the passes, no damage to the outlet guides and no winding of the bar around the rolls.

The rolling in the passes of the roughing train produces a symmetric rough I-beam which is readily rolled in the passes 28, 29, 30, 31, 32 and 33 of the finishing train (FIGS. 16 through 21).

According to another embodiment of the proposed method, I-section rolling is successively performed in the following passes of a medium section continuous mill:

1st stand—the horizontal open slitting pass 19 (FIG. 7);

2nd stand—the vertical reduction pass 20 (FIG. 8);

3rd, 4th and 5th stands—horizontal closed roughing beam passes analogous to the pass 5 (FIG. 2);

6th stand—a vertical bending pass analogous to the pass 8 (FIG. 8);

7th stand—a horizontal closed roughing beam pass analogous to the pass 12 (FIG. 4);

8th stand—a vertical bending pass analogous to the pass 16 (FIG. 5);

9th stand—a horizontal open beam pass analogous to the pass 17 (FIG. 6).

In the finishing train rolling is performed in the universal beam passes 28 (FIG. 16), 29 (FIG. 17), 31 (FIG. 19), 33 (FIG. 21) and in the horizontal open beams 30 (FIG. 18) and 32 (FIG. 20).

For rolling the bar in the horizontal closed roughing beam passes 5 (FIG. 2) and 12 (FIG. 4), the following side slopes should be used:

Live flanges

3rd stand—45 percent,
4th stand—65 percent,
5th stand—100 percent,
7th stand—20 percent.

Dead flanges

3rd, 4th and 5th stands—12 percent,
7th stand—8 percent.

In the vertical reduction pass 20 (FIG. 8) of the 2nd stand the outer sides of the bar flanges are worked to a slope of 12 percent which corresponds to the slope of the outer sides of the dead flanges of the succeeding horizontal closed roughing beam pass 5 (FIG. 2) of the 3rd stand.

In the vertical bending pass 8 (FIG. 3) of the 6th stand the bent-out flanges of the bar are worked to an outer side slope of 8 percent.

In the vertical bending pass 16 (FIG. 5) of the 8th stand the live flanges are worked upright.

The live flanges of the bar are worked in the 6th and 8th stands without changing the bar width in order to obviate instability of the web.

In the horizontal open beam pass 17 (FIG. 6) of the 9th stand the rolling of the bar is carried out according to a web thickness reduction ratio $H'_1/H_1$ of 1.2 and a flange height reduction ratio $H'_2/H_2$ of 1.3.

The rolling of the bar in the above stated sequence from the 1st stand to the 9th stand proceeds steadily, there being no impacts at the entry and exit of the bar into and from the passes, no damage to the outlet guides and no winding of the bar round the rolls.

The rough I-beam produced by rolling in the train from the 1st stand to the 9th stand has a true, symmetrical shape. By rolling it in the finishing train a high-quality I-beam is produced.

What is claimed is:

1. A method of rolling I-sections in a continuous mill, comprising the steps of:

(1) rolling a blank in a horizontal slitting pass to form a roughly I-shaped bar;

(2) rolling said bar in a vertical reduction pass until outer sides of said bar have slopes approximately equal to outer sides of dead flanges of a next-in-order horizontal closed roughing beam pass, and the width of said bar is less than the width of said next-in-order pass;

(3) rolling said bar in a horizontal closed roughing beam pass;

(4) rolling live flanges of said bar in a vertical bending pass until the slopes of outer sides of live flanges of said bar are approximately equal to the magnitude and direction of the slopes of the outer sides of dead flanges of a next-in-order horizontal closed roughing beam pass, and the width of said bar is not reduced;

(5) rolling said bar in a horizontal closed roughing beam pass;

(6) rolling live flange of said bar in a vertical bending pass, wherein bent-out live flanges of said bar are set upright;

(7) rolling said bar in a horizontal open beam pass to form a rough finished I-section, wherein the web thickness reduction ratio and the flange height reduction ratio are both in the range 1.1–1.3;

(8) rolling said rough finished I-section in an universal beam pass to form a finished I-section;

wherein outer sides of live flanges of each of said horizontal closed roughing beam passes have a slope of 15–100 percent and outer sides of dead flanges of said horizontal closed roughing beam pass have a slope of 8–12 percent; and wherein the slopes of outer sides of flanges of successive horizontal closed roughing beam passes are in alternate directions.

2. A method of rolling I-sections according to claim 1, wherein steps 4 and 5 are repeated.

3. A method of rolling I-sections according to claim 1, wherein said bar may be rolled one to three times in horizontal closed roughing beam passes between rolling said bar in successive vertical bending passes, said horizontal closed roughing beam passes having the same direction of slope of outer sides of live and dead flanges.

* * * * *